United States Patent [19]

Purinton et al.

[11] 4,249,167

[45] Feb. 3, 1981

[54] APPARATUS AND METHOD FOR THEFT DETECTION SYSTEM HAVING DIFFERENT FREQUENCIES

[75] Inventors: Edwin C. Purinton, Oreland; Robert L. Auger, Lansdale; Carl S. Holzinger, Coopersbury, all of Pa.

[73] Assignee: Magnavox Government and Industrial Electronics Company, Fort Wayne, Ind.

[21] Appl. No.: 45,808

[22] Filed: Jun. 5, 1979

Related U.S. Application Data

[63] Continuation of Ser. No. 907,539, May 19, 1978, which is a continuation of Ser. No. 698,249, Jun. 21, 1976.

[51] Int. Cl.[3] ..... G08B 13/18

[52] U.S. Cl. ..... 340/572; 340/551

[58] Field of Search ..... 340/572, 551; 343/6.5 LC, 6.8 LC, 6.8 R

[56] References Cited

U.S. PATENT DOCUMENTS

| | | | |
|---|---|---|---|
| 3,631,442 | 12/1971 | Fearon | 340/572 |
| 3,665,449 | 5/1972 | Elder et al. | 340/572 |
| 3,673,437 | 6/1972 | Wright | 340/572 |
| 3,697,972 | 10/1972 | Brown | 340/551 |
| 3,697,996 | 10/1972 | Elder et al. | 340/382 |
| 3,707,711 | 12/1972 | Cole et al. | 340/572 |
| 3,747,086 | 7/1973 | Peterson | 340/572 |
| 3,790,945 | 2/1974 | Fearon | 340/572 |
| 3,820,104 | 6/1974 | Fearon | 340/572 |
| 3,990,065 | 11/1976 | Purinton et al. | 340/572 |

*Primary Examiner*—Glen R. Swann, III

*Attorney, Agent, or Firm*—William J. Iseman; William J. Streeter; Thomas A. Briody

[57] ABSTRACT

Two different frequencies are generated within an interrogation zone. The receiver portion of the system determines the presence of a predetermined marker tag within the interrogation zone by the sensing and processing of a ratio of sideband signals generated by the interaction of the two different frequencies and the predetermined marker tag. The system is greatly immuned to false alarms due to the method of processing the sensed sideband signals. Falsely generated signals are nulled and subtracted out in the receiver portion of the detection system.

31 Claims, 3 Drawing Figures

APPARATUS AND METHOD FOR THEFT DETECTION SYSTEM HAVING DIFFERENT FREQUENCIES

This is a continuation of application Ser. No. 907,539, filed May 19, 1978, which is a continuation of application Ser. No. 698,249, filed June 21, 1976.

BACKGROUND OF THE INVENTION

This invention relates to methods and systems for detecting the presence of a magnetic object within a predetermined zone. More particularly, the present invention relates to an improved method and apparatus for detecting the passage of an item having the magnetic object attached thereto through an interrogation zone.

In the past there have been many different systems proposed for use in detecting pilferage of items from an enclosed area by persons who normally have access to the enclosed area. Many anti-pilferage systems detect passage of an item through an exit point by monitoring for a signal emitted by a transponder attached to the item. A common anti-pilferage system generates a magnetic alternating field in an exit passageway through which all persons within the enclosed area must exit. A search is made for preselected harmonics that are generated by a high permeability magnetic tag attached to the item when the tag is within the alternating field. Another anti-pilferage system proposed in the past generates two different frequencies within the exit passage way and then monitors for sum and/or difference frequencies created when the high permeability marker or tag passes through the exit way. A simplified version of such a system is described in U.S. Pat. No. 3,631,442. The use of high permeability magnetic tags attached to items desirous of being protected from pilferage was taught in French Pat. No. 763,681 which issued to Pierre A. Picard.

One of the shortcomings with the systems of the past is the tendency to generate an alarm when an item bearing the tag is not present within the exit way or interrogation zone. Not only are these false alarm systems embarrassing to the personnel monitoring the theft detection system, but they can also subject the management of the enclosed area to a law suit by the individual subjected to questioning or accused of causing the alarm. Repeated false alarms eventually cause personnel monitoring the theft detection system to ignore all alarms whether false or not. It will therefore be appreciated that it would be desirable to have a theft detection or anti-pilferage system that does not generate false alarms.

The present invention relates to a system having greatly improved resistance, over prior art systems, to the production of false alarms caused both by passage through the interrogation zone of miscellaneous metallic items and by the presence of extraneous environmentally caused interference. This improved theft detection system also has greatly improved sensitivity to the marker tag employed so that improved detectability is obtained. The improved system allows detection of the marker tag to be made even in cases of simultaneous passage through the interrogation zone of larger sized competitive metallic objects which would inhibit previous systems from making such a detection. This improved system introduces new means for operating in the presence of large stationary metallic objects, such as underlying steel floor beams or metallic columns which would normally disrupt the proper operation of prior systems. The improved system employs low amplitude audio frequency magnetic fields in the interrogation zone.

Accordingly, one of the objects of the present invention is to provide an improved theft detection system which has a greatly improved resistance to the production of false alarms.

Another object of the invention is to provide a theft detection system which generates two different frequencies within an interrogation zone and senses a ratio of sidebands generated from the two frequencies by a tag within the interrogation zone.

A further object of the present invention is to provide a receiver portion of a theft detection system which operates upon signals in a manner to essentially eliminate false alarms.

Yet another object of the present invention is to provide an improved method of monitoring an interrogation zone to determine the presence of a tag within the zone and uniquely processing a sensed signal in a manner to eliminate false alarms.

SUMMARY OF THE INVENTION

In carrying out the above and other objects of the invention in one form, we provide an improved theft detection system for sensing the presence of a marker or tag within an interrogation zone. One illustrated improved detection system has a first means for generating a low frequency signal and a second means for generating a high frequency signal. Means are provided for combining the low frequency and high frequency signal and for applying the combined signals to an interrogation zone. Sensing means are used to sense any perturbations caused within the interrogation zone by presence of a predetermined magnetic tag within the interrogation zone. Frequency conversion means or means for mixing are used to mix the perturbations sensed with the high frequency signal to produce at least one base frequency which is equal to the difference between the high frequency signal and a frequency contained within the perturbations. Means for comparing the at least one base frequency against the predetermined threshold level are provided. Whenever the amplitude of the base frequency exceeds the predetermined threshold level, an alarm is created with an alarm means. Also provided are means for inhibiting the at least one base frequency from entering the means to compare whenever the perturbations are higher than expected to be caused by the presence of a reasonably sized tag. This means for inhibiting greatly reduces false alarms caused by objects other than the tag within the interrogation zone.

A method of detecting the presence of a high permeability magnetic tag within an interrogation zone is also provided. This is done by generating signals of two different frequencies and applying the signals to the interrogation zone. Sidebands within the interrogation zone which are generated by interaction between the two different frequencies and the tag are then sensed. The sidebands are filtered to remove frequencies other than the sideband frequencies. The sideband frequencies are then mixed with one of the two different frequencies to obtain at least one base frequency equal to the difference between the sideband frequencies and one of the two different frequencies. The obtained at least one base frequency is then filtered. The at least one base frequency can be inhibited should there be received with the sidebands amplitudes of the high frequency signal which are greater than expected. Amplitude of the at least one base frequency is then compared against the predetermined amplitude and an alarm is generated when the at least one base frequency exceeds the predetermined amplitude.

The subject matter which we regard as our invention is set forth in the appended claims. The invention itself, however, together with further objects and advantages thereof, may be better understood by referring to the following detailed description taken in conjunction with the accompanying drawings.

Figure 1:
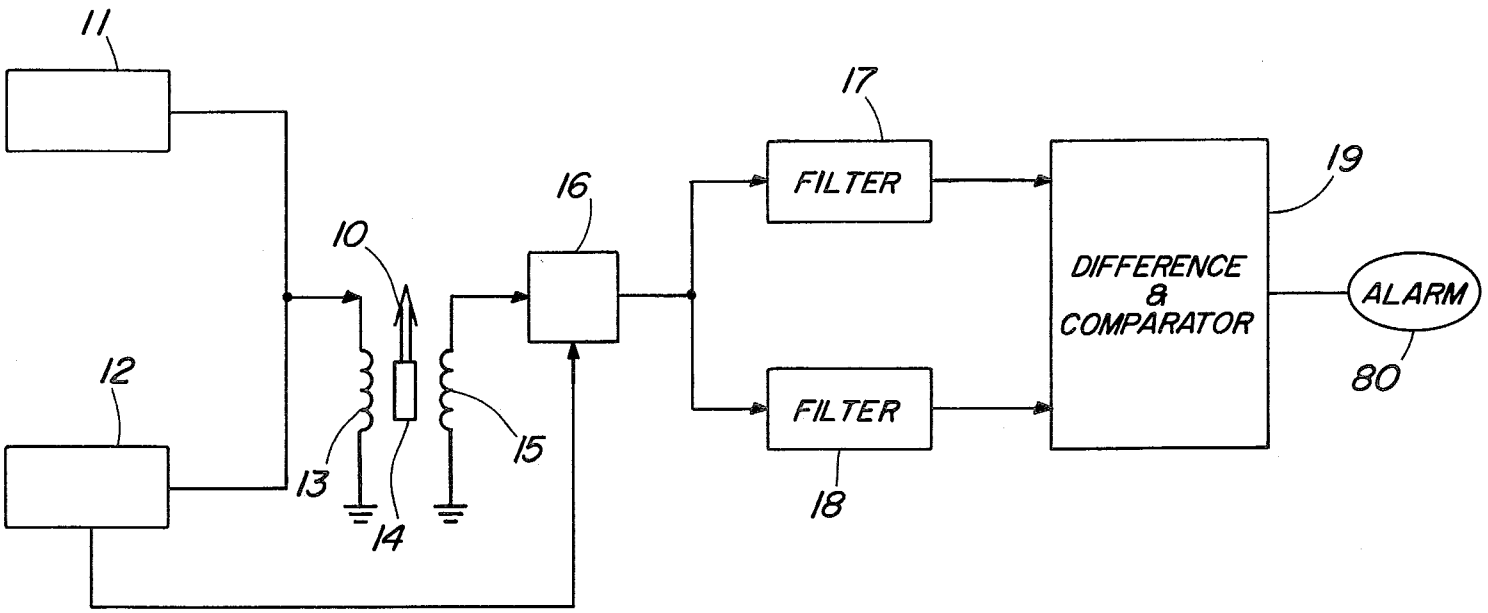
FIG. 1 is a simplified version of a block diagram that embodies the invention in one form.

The exemplifications set out herein illustrate the preferred embodiments of the invention in one form thereof and such exemplifications are not to be construed as limiting in any manner.

DESCRIPTION OF THE PREFERRED EMBODIMENTS

Referring to the drawings in general, a system and method is provided to detect the presence of a specially constructed marker or tag. The tag is intended to be attached in an unobvious place to items which are to be protected from pilferage. By way of example these items may be books in a library or items of clothing in a retail store, or any other object that may be removed by unauthorized persons from an enclosed area. Detection of a theft in progress can be made by an alarm given when any item bearing the special tag is carried through a magnetic field produced in an interrogation zone which is normally located at the exit of the area that is being protected. The system employs low amplitude audio frequency magnetic fields to perform the effective frisking in the interrogation zone. The special tag can be a piece of low coercive force magnetic material.

A long thin piece of low coercive force magnetic material, such as Permalloy, generates sum and difference frequencies when exposed to a superimposed large amplitude lower frequency ($f_{low}$) and a smaller amplitude higher frequency ($f_{high}$) audio frequency magnetic field. A characteristic of these generated sum and difference frequencies which is unique to the special low coercive force material employed is the abundance of strong frequency components, for high n, at the frequency f, where n is defined by $$f = f_{high} \pm n\, f_{low}.$$

Using terminology that is commonly used in the communications field, one would say that the low coercive force magnetic material generates a spectrum in which the amplitudes of the sidebands fall off more slowly than those generated by ordinary magnetic materials. The present system utilizes the prolific generation of strong sideband signal components in the low coercive force magnetic material by basing the detection process on sensing for the ratio in amplitudes of two of the sidebands. In the preferred embodiment, the ratio of the amplitude of the third lower sideband to the amplitude of the second lower sideband was chosen, that is the ratio $$\frac{\text{amplitude of } (f_{high} - 3f_{low})}{\text{amplitude of } (f_{high} - 2f_{low})}.$$

For conductive nonmagnetic metals neither of these sidebands are generated so that, in addition to the stated ratio, the system of the present invention also looks for the presence of some third lower sideband signal since the ratio becomes undefined under these no signal conditions. For ordinary magnetic metals the ratio will be quite small, while for a Permalloy tag it will be relatively large.

FIG. 1 illustrates in block diagram form a simplified system arrangement. An oscillator 11 generates sinusoidal signals of low frequencies ($f_{low}$) while an oscillator 12 generates sinusoidal frequencies of a higher frequency ($f_{high}$). These sinusoidal signals simultaneously drive currents through a coil of wire 13 thereby setting up a dual frequency magnetic interrogation field in an aisleway or interrogation zone which potentially contains a contraband item bearing a marker or tag 14. The tag 14 would normally pass in the direction as indicated by arrow 10 and only be within the interrogation zone for a short period of time. Interaction of the two frequencies in the nonlinear magnetic tag material generate new magnetic fields containing new frequencies which induce small voltages at these new frequencies in coil 15. Amplification, filtering, and frequency shifting occur in circuit 16 which produces two sinusoidal signals with amplitudes in like proportion to those of two sidebands as orginally induced in receiver coil 15. These two sinusoidal signals are separated out by bandpass filters 17 and 18, respectively. In one preferred embodiment it was chosen to use the second and third lower sidebands which yielded two sinusoidal signals or base signals out of circuit 16 which were equal to two and three times the low frequency ($f_{low}$). Difference and comparison circuit 19 then takes the difference in amplitude between the signal coming from filter 17 and the signal coming from filter 18. The difference in amplitude is compared against a reference to determine if the difference, which is representative of the ratio of sidebands, is sufficient in amplitude to warrant an alarm. If an alarm is warranted alarm 80 is activated.

Figure 2A:
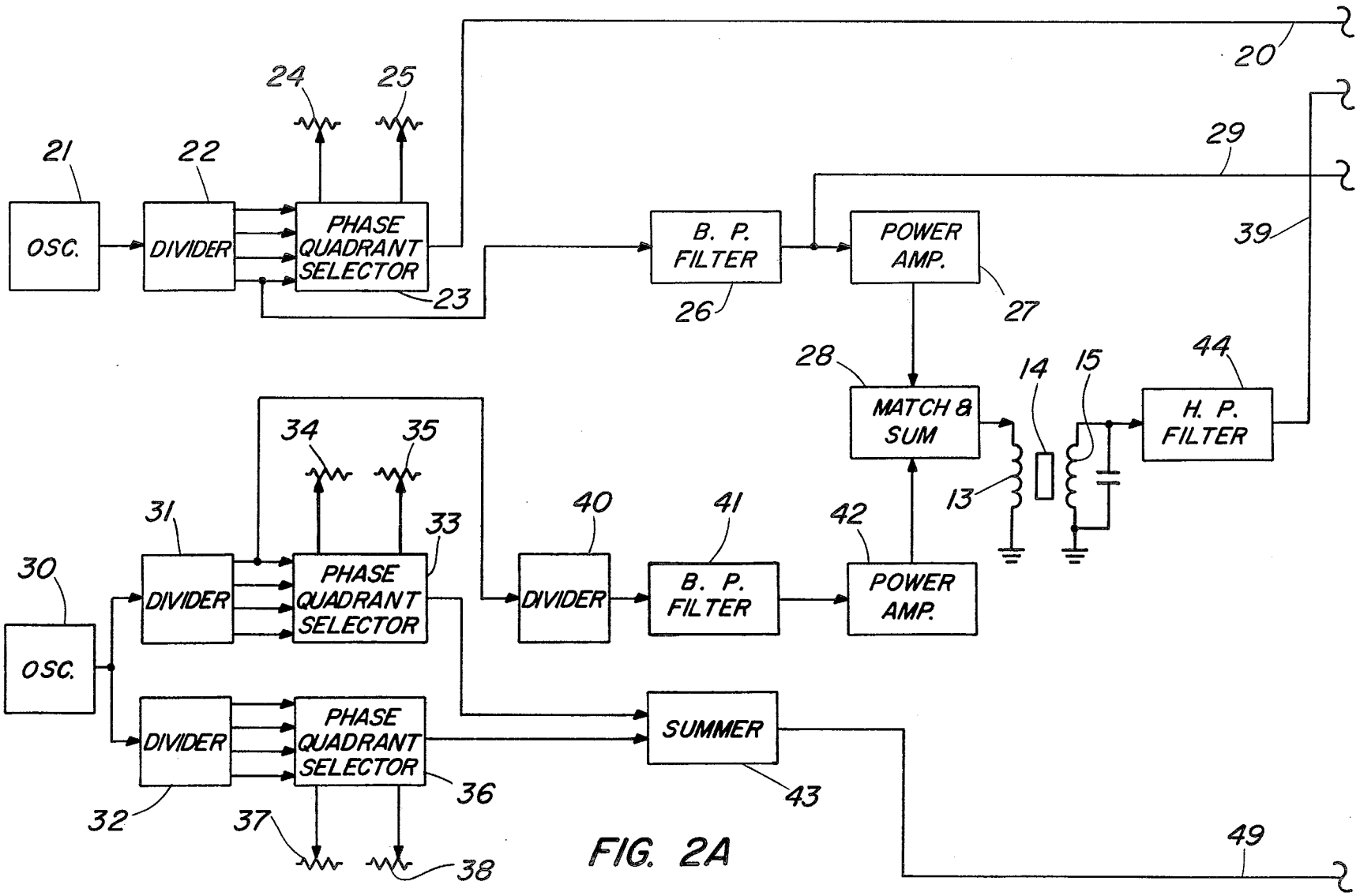
FIGS. 2A and 2B combined is a detailed block diagram of the invention in one form.
Figure 2B:
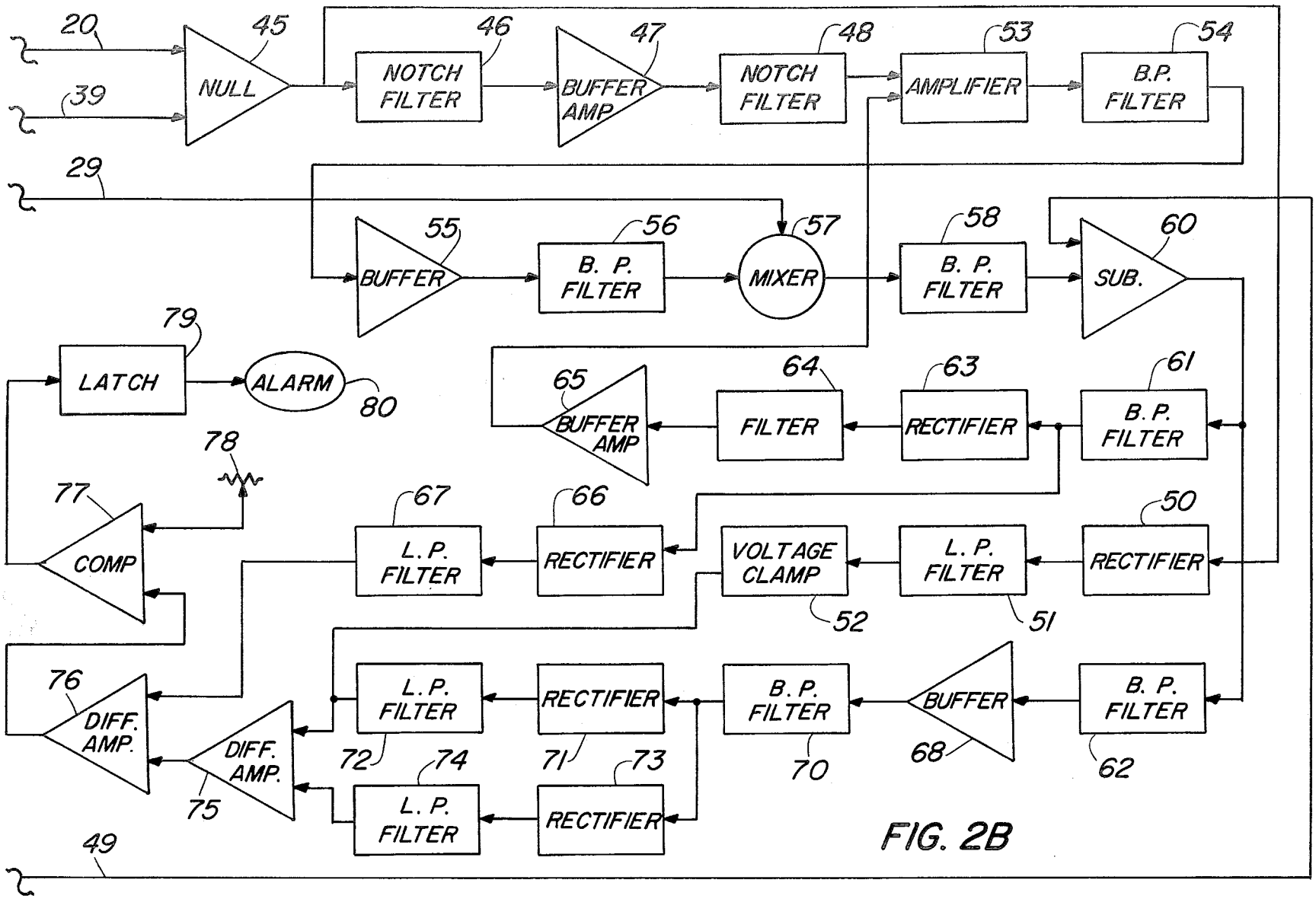

Referring now to FIGS. 2A and 2B there is illustrated a detailed block diagram of the preferred embodiment of the invention. A magnetic field utilized in the interrogation zone consists of a superimposed low frequency sinusoidal field and a higher frequency sinusoidal field. Both frequencies are in the audio range with the lower frequency signal being larger in amplitude than the higher frequency signal. These two frequencies are synthesized digitally by first generating a high frequency squarewave with an astable multivibrator 21 and generating a low frequency squarewave with an astable multivibrator 30. The final frequencies utilized in the interrogation zone are not directly generated because of the need to also generate some additional frequencies required in the detection process of the system.

The high frequency signal generated by multivibrator or oscillator 21 is divided by two in divider 22. The divider 22 incorporates circuitry to produce four separate output signals each ninety degrees out of phase from each other. The need for four out-of-phase signals will be described hereinafter. In producing the interrogation field to be used in the interrogation zone, the next step is to pass one of the output signals from divider 22 through a bandpass filter 26 in order to greatly attenuate all frequency components of the squarewave generated by multivibrator 21 except the desired high frequency signal. Bandpass filter 26 has two outputs one of which goes to power amplifier 27 wherein the high frequency signal is amplified and then delivered to matching and summing network 28. The second output of filter 26 is connected by line 29 to a mixer 57, whose function will be discussed later. The low frequency squarewave produced by oscillator or multivibrator 30 is divided by six by divider 31. The divider 31 also incorporates circuitry to produce four output signals each ninety degrees from each other. Another auxiliary signal required in the processing stages in the detection portion of this system is generated at this time by dividing the low frequency squarewave produced by oscillator 30 by the factor four in divider 32. Divider 32 also incorporates circuitry to produce four output signals each ninety degrees out of phase from each other. To obtain the final low frequency signal required for interrogation, one of the output signals from divider 31 is further divided by two by divider 40 to produce a low frequency squarewave. This low frequency squarewave is then passed through a bandpass filter 41 in order to attenuate all frequency components of the squarewave except the fundamental frequency. The output frequency from bandpass filter 41 is then amplified in power amplifier 42. The output of power amplifier 42 is connected to matching and summing network 28. Network 28 performs the function of allowing both the low frequency signal from amplifier 42 and the high frequency signal from amplifier 27 to be efficiently fed in a concurrent manner into a transmitting coil 13 without having significant feedback of either frequency component into the output of the power amplifier amplifying the other frequency component.

Detection of the presence of a tag 14 within the interrogation zone is accomplished by processing the signal components of the second and third lower sidebands produced when the concurrent larger amplitude low frequency sinusoidal magnetic field and the smaller amplitude high frequency sinusoidal magnetic field interact in the low coercive force nonlinear hysteretic magnetic material of tag 14. These two sideband frequencies are equal to the high frequency minus twice the low frequency signal and the high frequency minus three times the low frequency signal.

In practice extraneous signal components at frequencies of the sideband frequencies may also be produced by large pieces of magnetic metals unavoidably positioned in the vicinity of the transmitting coil 13. For example, steel reinforcing rods may be in the concrete floor upon which the coil 13 is positioned or steel floor beams or steel columns may be in the nearby floor or wall areas. In order to improve overall system sensitivity it is desirable to provide for the electronic cancellation of these fixed background extraneous signals. Rather than using circuitry to cancel these objectionable fixed frequency and phase signals at exactly the sideband frequencies of which they are actually generated, it proves convenient to cancel their effects at a later stage in the system signal processing scheme where these two frequency signals happen to have been down shifted in frequency to two and three times the value of the low frequency signal, respectively. Since an arbitrary amplitude and phase of each of the two extraneous signals can be encountered one will require an arbitrary amplitude and phase signal at both two and three times the frequency of the low frequency signal in order to be able to cancel the effects of the presence of any of these large fixed pieces of magnetic metals. Although a system can be arranged which adaptively, i.e., automatically, selects the correct cancellation phase and amplitude, such a scheme is not normally required since the interfering items are stationary or fixed in position. Accordingly, phase quadrant selector 33 receives four squarewave signals from divider 31. These squarewave signals are equivalent to twice the low frequency signal that is fed to transmitting coil 13. When the system is being installed at an exit point of an area being guarded against pilferage, the installation technician manually selects one of the four squarewave signals as a basis for the cancellation of the background signal that becomes equivalent to twice the low frequency signal. Phase quadrant selector 36 receives four squarewave signals from divider 32. The signals received by phase quadrant selector 36 are equivalent to three times the low frequency signal delivered to transmitting coil 13. Again, the technician manually selects one of these four signals as the basis for the cancellation of the background signal equivalent to three times the low frequency signal. In both cases the four input signals are arranged such that if one signal is at a phase of 0°, then the remaining three signals are at 90°, 180° and 270°. Thus by having selected the appropriate basic signal with phase quadrature selector 33, it is then possible to make fine phase and amplitude adjustments with phase adjust potentiometer 34 and amplitude adjust potentiometer 35 to yield a cancellation signal equivalent to twice the low frequency signal of any required phase and amplitude. Likewise, by first selecting the appropriate basic signal with phase quadrature selector 36 it is possible to make fine phase and amplitude adjustments with phase adjust potentiometer 37 and amplitude adjust potentiometer 38 to yield a cancellation signal equal to three times the low frequency signal of any required phase and amplitude. The selected outputs from phase quadrant selectors 33 and 36 are delivered to summer 43 where the outputs are summed. The output of summer 43 is connected by line 49 to a subtractor 60 whose function will be explained hereinafter.

Because this theft detection system is extremely sensitive it is advantageous to minimize the presence of either of the two original magnetic field frequency component signals in the electronic amplifying stages. This is because the presence of these two signals, even if not large enough to saturate the amplifiers, can, via the process known as intermodulation distortion, generate additional objectionable signal components at the two sideband frequencies. The desired signal components produced by the tag 14 at the sideband frequencies are received by means of a tuned receiver coil 15. The output of receiver coil 15 is fed through a highpass filter 44 and then carried by line 39 to a null circuit 45. Since receiver coil 15 is of a fairly high Q and is tuned to the sideband frequencies and then its output is further passed through the highpass filter 44, a negligible component of the low frequency signal is left to contend with. However, the high frequency signal is not so drastically attenuated because it is much closer to the passband for the desired sideband frequencies. Therefore, a signal of arbitrary phase and amplitude at a frequency equal to the high frequency signal is generated with phase quadrant selector 23, phase adjust potentiometer 24 and amplitude adjust potentiometer 25 in the same manner as previously described for generating signals with quadrant selectors 33 and 36. This cancellation signal is then carried by line 20 to a null circuit 45. Any high frequency signal component which is inadvertently passed through the output of highpass filter 44 is then vastly suppressed in the signal processing chain by electronically subtracting the appropriate cancellation signal supplied by phase quadrant selector 23 in the null circuit 45. Since the passage of both magnetic and electrically conductive bodies through the interrogation zone can temporarily unbalance the magnetic fields and feed varying amounts of the low frequency and high frequency signals into receiver coil 15, one can never hope to obtain perfect elimination of the high frequency signal in this manner. Therefore, to eliminate this variable high frequency signal input component the signal out of null circuit 45 is passed through a high frequency signal notch filter 46 then through a buffer amplifier 47 and then another high frequency signal notch filter 48. Even with these drastic measures taken to eliminate the high frequency signal component, it is still possible for the passage of a large enough piece of metal, such as a large metal garbage can, to produce high frequency signal levels which exceed the dynamic range of some signal processing stages. To prevent the possibility of a passage through the interrogation zone of an excessively large piece of metal from producing any false alarms as the result of excessive high frequency signal overloading of any signal processing stages, an automatic momentary system shut-down feature is provided. Excessive signal levels (effectively those of the high frequency signal) which appear at the output of null circuit 45 are rectified by a rectifier 50, filtered by lowpass filter 51, and then used to drive a voltage clamp 52 which will, in effect, produce a "zero" output which will, as hereinafter explained, inhibit any signals from proceeding through the system which are capable of producing an erroneous alarm.

The desired sideband frequency signals are processable over a wide dynamic range of amplitude since the output of notch filter 48 is fed through an automatic gain control stage 53 for which it will be seen derives its gain controlling signal effectively from the amplitude of the higher frequency of the two sideband components. In an ideal situation where only a marker or tag 14 is present within the interrogation zone, the amplitude of the high frequency sideband signal will be quite small and the gain of automatic gain circuit 53 will be high. If, however, other items besides the tag 14 are being carried through the interrogation zone they may produce such large sidebands of the high frequency signal levels as to require the gain of automatic gain circuit 53 to be dynamically lowered to prevent distortion in the subsequent signal processing stages.

Further filtering and buffering to preserve only the lower sideband frequency components is accomplished by passing the output of automatic gain circuit 53 through a bandpass filter 54 tuned to pass the two lower sideband frequencies, a buffer 55, and then through another bandpass filter 56 also tuned to the lower sideband frequencies. The sideband frequencies presented at the output of bandpass filter 56 are shifted down in frequency by applying these signals along with a reference high frequency signal, taken from the output of high frequency bandpass filter 26, to a frequency converter or a mixer 57. The mixer 57 then mixes the high frequency signal with the sideband frequencies to produce two base frequencies which are equal to two times and three times, respectively, the low frequency signal (delivered to coil 13) because the sidebands fed into mixer 57 by bandpass filter 56 were equal to the second and third lower sideband signals. The output from mixer 57 is then fed through another bandpass filter 58 in order to retain only the base frequency signals of twice and three times the low frequency signal.

At this stage the previously mentioned extraneous signals, as caused for example by nearby steel beams, are nulled out by combining the properly adjusted output signals at frequencies of twice the low frequency signal from phase quadrant selector 33 and three times the low frequency signal from phase quadrant selector 36 in summer 43. The output of summer 43 is then subtracted by means of a subtractor 60 from the main signal being processed by bandpass filter 58. The main signal being processed comprises two base frequencies equal to two times and three times the low frequency signal. As will be understood by persons skilled in the art, a system operating in a normal environment containing some unavoidable large pieces of magnetic material adjacent the interrogation zone will produce some background difference signal at the output of bandpass filter 58 even in the absence of anything being carried through the interrogation zone. However, the present system, by the use of phase quadrant selectors 33 and 36 and properly adjusted potentiometers 34, 35, 37, and 38 will have negligible difference extraneous signal components at the output of subtractor 60. Then, besides the potential reception of extraneous radiated noise signals by tuned receiver coil 15, only items being carried through the interrogation zone of the theft detection system are thus capable of producing base frequency signal components equal to twice and three times the low frequency signal at the output of the subtractor 60.

The detection of the marker or tag 14 depends upon the recognition that the ring 14 unlike other competitive metals produces a considerably larger ratio of a signal level at three times the low frequency signal to a signal level at twice the low frequency level. It is thus necessary to now separate the output from subtractor 60 by simultaneously applying this output to a bandpass filter 61 which is tuned to pass frequencies equal to twice the low frequency signal and to a bandpass filter 62 which is tuned to pass frequencies equal to three times the low frequency signal. Bandpass filter 61 has two outputs. One output is converted into the previously described gain controlling signal for the automatic gain control circuit 53 by passing this output through a rectifier 63, a filter 64, and a buffer amplifier 65 before applying the result to the gain control input of automatic gain circuit 53. The second output of bandpass filter 61 is passed through another rectifier 66 and then a low pass filter 67 to provide a reference level used to moderate a corresponding level which is produced in response to the output of bandpass filter 62 (which is equivalent to three times the low frequency signal). That is, the system operates to produce an alarm if the amplitude of the signal at three times the low frequency signal is larger than the amplitude of the signal at twice the low frequency signal and not simply if a certain amplitude at the three times low frequency signal level is present. This mode of operation prevents the generation of alarms by relatively large competitive magnetic materials since they, besides generating a sufficient base signal equivalent to three times the low frequency signal converted level, in addition always generate an even larger base frequency equal to twice the low frequency signal converted level.

If a tag were present simultaneously with large competitive magnetic materials, the difference or base signal level at three times the low frequency signal will generally be larger than the difference or base signal level at twice the low frequency signal, thus producing an alarm. The system will operate under these conditions even if the signal of processing gain is reduced by automatic gain circuit 53 due to a large difference signal at twice the low frequency signal.

The output signal from bandpass filter 62 is processed somewhat differently from the way the signal at twice the low frequency signal is processed. The reason for this difference is to provide for the possibility of building safeguards into the system for preventing needless false alarms. Since it is basically the amplitude of the base signal at three times the low frequency signal which is responsible for establishing whether or not an alarm should be given, it will suffice to block this signal's path to a difference amplifier 75 if a questionable situation should arise. Even though the receiver coil 15 is of a fairly high Q and the receiver coil is arranged geometrically so as to cancel out the reception of any signals originating geometrically far away from the coil it may still be possible to induce some transitory signals equal to the third lower sideband thus resulting in a signal component at three times the lower frequency signal in the system. A typical situation might occur as a person carries some multicomponent metallic object through the interrogation zone where, because of slight jarring, microscopic contacts are inadvertently being made and broken so as to make and break conduction paths in the interrogation zone. Because of the starting and stopping of these small currents set up in the loops by the low frequency signal and high frequency signal interrogation magnetic fields the receiver coil 15 is excited by a random sequence of small impulse-like functions. Since such an excitation is broad-band excitation, the tuned receiver coil 15 is bound to pick up some transitory signals equivalent to the third lower sideband. To safeguard against the possibility of this making and breaking of such conduction loops from generating a false alarm, the output of bandpass filter 62 is passed through a buffer amplifier 68 and then an additional bandpass filter 70 before being split into two parallel processing paths. The main path, i.e., the one that could suffice if the above mentioned false alarm protection were not incorporated, simply rectifies the output of bandpass filter 70 by means of a rectifier 71 and filters the result by means of a low pass filter 72. As explained hereinbefore, too large an extraneous input signal equal to the high frequency signal will cause the output of clamp 52 to go to a zero or ground level and therefore short the output of lowpass filter 72 to ground preventing any signal information in this path from passing this point. If voltage clamp 52 is not excited, as is normally the case, then the output of lowpass filter 72 will pass directly into the difference amplifier 75. The second input to the difference amplifier 75 is obtained by taking the output of bandpass filter 70 and passing it through a rectifier 73 and a lowpass filter 74 before feeding it into difference amplifier 75. The signal entering difference amplifier 75 from lowpass filter 74 is polarized and of a magnitude which substantially opposes the signal entering difference amplifier 75 from lowpass filter 72. Thus almost a standoff situation is realized but with things weighted so that under normal operation the output from lowpass filter 72 is able to dominate. The inputs to difference amplifier 75 results in a level into difference amplifier 76 from difference amplifier 75, which now, if unopposed from a level supplied by lowpass filter 67 (as a result of the presence of a significant signal component equal to twice the low frequency signal) will drive a comparator 77 in a direction which can subsequently produce an alarm if the output from difference amplifier 76 exceeds a required threshold. The required threshold can be controlled by setting an alarm threshold potentiometer 78. If the output from difference amplifier 76 exceeds in amplitude that established by alarm threshold potentiometer 78 then the output of the comparator 77 trips a latch 79 which, in turn, drives an alarm 80. The latch 79 assures the continuance of the alarm even after a tag 14 has already passed through the interrogation zone. The latch 79 can be such as to be reset by authorized personnel or by a time delay circuit. Suppression of potential false alarms which could originate by the aforementioned making and breaking of conduction loops or reception of transitory signals by the receiver coil 15 from sources unknown are eliminated by having the time constant of lowpass filter 74 be shorter than the time constant of lowpass filter 72. In this manner rapidly appearing and disappearing noise signals having significant energy at a frequency equal to the third lower sideband are able to reach difference amplifier 75 through the path polarized to drive the input to difference amplifier 76 provided by difference amplifier 75 in a direction away from signifying an alarm condition, while these same objectionable transitory signals are attenuated significantly more as they pass through the main alarm path of rectifier 71 and lowpass filter 72 in reaching the input of difference amplifier 75. In this way, the normal standoff condition of having the output of lowpass filter 72 dominate the output of lowpass filter 74 is reversed for the transitory signals and false alarms are suppressed.

It will be recognized by those persons skilled in the art that the frequency of the oscillators 21 and 30 will both depend upon the low frequency signal and high frequency signal desired or selected. Although in the past some theft detection systems have used frequencies in the radio frequency as well as the microwave region, in the preferred embodiment of the present invention frequencies in the audio range are preferred.

The successful operation of the overall system crucially depends upon the tag 14 having the rather unique ability to generate relatively larger amounts of magnetic flux variation (than common metallic materials) at the third lower sideband frequency than magnetic flux variation at the second lower sideband frequency when marker or tag 14 is exposed to a concurrently applied colinear larger amplitude low frequency signal biasing magnetic field intensity and a lower amplitude higher frequency signal interrogation magnetic field intensity. The ability of a tag 14 to yield this rather unique response is dependent upon a variety of considerations which are discussed hereinafter.

The basic operation of the system depends upon the ability of the biasing magnetic field intensity being able to periodically swing or alternate the magnetic state of the tag between regions of high and low differential permeability. In order to most effectively differentiate the tag from other magnetic materials it is thus desirable to select a tag material which is most easily biased into these states of differing differential permeability while at the same time maximize the difference in the differential permeabilities at the extremes of these different states. To those persons skilled in the art, it is obvious that a material known in the trade as Supermalloy is a good choice. Because of economic considerations one might also select an almost as good a material known as Permalloy. The importance of selecting materials like Permalloy for application in theft detection tags in general was long ago recognized by Pierre A. Picard (See French Pat. No. 763,681). Although the Picard patent does not teach applying dual magnetic fields, his reason for selecting Permalloy is basically the same as ours, that is, it is very easily magnetized while at the same time having a respectable magnetic flux density when fully magnetized.

The remainder of the magnetic compositions which might be carried through the aisleway or interrogation zone of a theft detection system are to various degrees more difficult to magnetize besides normally having a much smaller difference in the differential permeabilities between the extremes of the different states. Thus, one can exploit the relative uniqueness of the Permalloys by generating applied bias magnetic intensities in the interrogation zone which are only strong enough to cycle the tag material. The higher frequency interrogation magnetic field intensities are always of a smaller amplitude than the bias magnetic field intensities. For practical purposes, it normally is difficult to obtain uniform applied magnetic field intensities over the entire interrogation zone. This means that if the bias field intensity in the minimum strength locations is to be capable of cycling the tag other competing magnetic materials carried through the unavoidable higher field intensity regions may be partially cycled. However, besides the ease of cycling which the tag material almost uniquely enjoys, it also has an unusually high ratio of differential permeability in the high permeability state to differential permeability in the low permeability state.

The extent to which the differential permeability in the high permeability state exceeds the differential permeability in the low differential permeability state is monitored by using an additionally applied lower amplitude, higher frequency interrogation magnetic field intensity. Thus, during those periods of time in which the applied low frequency biasing magnetic field intensity has driven a magnetic material into a low differential permeability state, the component of the overall magnetic flux density variation in response to the high frequency applied magnetic field intensity are relatively small, whereas during those periods of time in which the applied low frequency biasing magnetic field intensity has driven the magnetic material into high differential permeability states, the components of the overall magnetic flux density variation in response to this high frequency applied magnetic field intensity are relatively large. The large variation in differential permeability possessed by the Permalloys is used to compensate for the practical difficulties of generating uniform magnetic fields in the interrogation zone. This is accomplished by utilizing the fact that even though various magnetic bodies carried through the higher field intensity regions of the interrogation zone might be partially cycled, their components of overall magnetic flux density variation in response to the additionally applied high frequency magnetic field intensity will not yield the same large excursions, as do the Permalloys, when the bias field cycles these materials.

When a magnetic body in general and the Permalloy tag of our preferred embodiment in particular, is exposed to the applied biasing magnetic field intensity and the concurrent interrogation magnetic field intensity there results a component of overall magnetic flux density variation in response to the high frequency applied magnetic field intensity. This overall response can be monitored by various means known to those skilled in the art. A common approach is to position one or more coils of wire in the vicinity of the interrogation zone so that as the time varying closure magnetic flux external to the specific magnetic body passes through these coils, it induces a time varying voltage in these coils herein referred to as the sense coils. One must then process the relatively complicated signal that has resulted. As those persons skilled in the art are aware, one should use as narrow a bandwidth as possible when processing weak signals in order to minimize the masking effects of noise. Since, in general, one also wishes to minimize the physical size of the tag in order to aid in its concealment on articles to be protected, it follows that the amplitudes of the voltages induced in the sense coils may be very small.

One possible means of processing the signals induced in the sense coils is to use very narrow band detection of one or more of the individual spectral components of that signal. Since the resulting spectrum contains many components there are many choices available. The results of experimental studies of the Permalloy produced spectrum along with spectra produced by a great variety of competing magnetic bodies, in addition to practical hardware and economic considerations, caused us to select a preferred embodiment which utilizes two frequency components of the induced spectra. These two selected frequency components are commonly known as the second and third lower sidebands. Many other choices are available and the use of the second and third lower sidebands is not intended to be limiting in any manner. In general, any or all of the spectral components may be utilized.

In the past others have claimed the use of one or more of the harmonics that result when only a single fundamental frequency magnetic field intensity is used to excite the tag material. In addition to the French patent to Picard mentioned hereinbefore, others have also proposed theft detection systems using harmonics such as U.S. Pat. No. 3,790,945 to E. R. Fearon. Also U.S. Pat. No. 3,631,442 to R. E. Fearon proposes a theft detection system that uses two different frequency applied magnetic fields of approximately equal energies to generate sum and difference frequency components in a nonlinear magnetic material. In contrast, the theft detection system of the present invention advocates the application of two different frequencies wherein it is important that the two field energies and the two frequencies bear the special relationship where the ratio of the low frequency field energy to the high frequency energy be in the order of 10 to 10,000. The preferred embodiment utilizes the ratio of about 100.

An additional very important consideration in selecting a tag is picking the correct geometry into which the tag material should be formed. It is well known in magnetics that magnetized bodies continuously try to demagnetize themselves. As a consequence of this fact, there have existed published equations, tables, and graphs showing the designer of magnetic devices how to properly account for this phenomenon. It is well known to persons skilled in the art that if one is to utilize a material having an inherently high permeability it is mandatory that the field be applied parallel to the long axis of a long thin piece of the material and that the higher the inherent permeability of the material, the larger the ratio of length to width need be. Since the maximum differential permeability of Permalloy is in the order of 100,000, the plots indicate the need to use a strip in which the length-to-width ratio exceeds roughly 1000 if one is not to waste any of the material's potential. The implication then is that once one has settled upon Permalloy as the material to be used in the tag, he must then properly select the geometry. The tag should then be long and thin. The particular cross-sectional shape is not overly critical in thin samples nor at the relatively low frequencies employed in the preferred embodiment. A good economic choice, as well as a reasonable engineering choice, is to utilize the thin Permalloy tape as is commonly employed in what are called tape cores. This material is available in widths of 0.125 inches with thicknesses such as 0.001 inches. A very thin tape yields a very small external closure flux density and very small induced voltages in the sense coils but can result in the shortest length tags. A very thick sample yields larger external closure flux densities and larger induced voltages in the sense coils, but must be made quite long in order to retain a satisfactory length-to-width ratio (when computing the length-to-width ratio for a noncircular cross sectional area, it is common to use an effective width of about the square root of the actual cross-sectional area). In the preferred embodiment, the tag can comprise a Permalloy tape of about 0.125 inches by 0.001 inches and a length of about 4 inches.

Since the art teaches one that it is necessary to have the applied magnetic field intensity roughly parallel to the long axis of our tag in order to be effective in changing the internal magnetic flux, one should ideally use a composite tag containing multiple long thin strips oriented in three dimensions like the rays from a point source of light. A more practical planar solution would be to form the tag like a "T" or an "X" or some similar configuration. Although these latter planar suggested shapes are less than ideal, they can often form a practical economic solution to the problem. This is because the applied magnetic field intensity in the interrogation zone will in general have a directon that varies from one specific location to another within the overall interrogation zone. In this way, upon the passage of a randomly oriented composite planar tag through the interrogation zone the probability of a long axis of one magnetic tag coming into rough alignment with the applied magnetic field intensity direction while passing through the interrogation zone is very high.

A further consideration in designing a tag is whether it can be activated or deactivated conveniently by authorized personnel. This feature is especially desirable in situations like a library. There, it is convenient to maintain all the tags attached to books on hand in the active state, and for the librarian to be able to deactivate the tag upon checkout by a borrower. In such a case, all visitors to the library will exit through a common exit or interrogation zone, however, an alarm will be sounded only when a person attempts to carry out a book that has not been checked out through the librarian.

The activate-deactivate ability can be obtained by extending the basic concept upon which the present theft detection system operates. That is, since the low frequency bias field is used to bias the tag into regions of various differential permeabilities, the tag simply needs to be exposed to a constant magnetic field intensity which is large enough to bias the tag material constantly into a region of very low differential permeability. This requires that the constant field intensity be larger than the low frequency bias field intensity so that the bias field at no time is strong enough to significantly counteract the effects of the constant field. In this manner the high frequency interrogation magnetic field intensity can only elicit a very small magnetic flux change in the tag material during all phases of the applied low frequency bias magnetic field intensity. This results in drastic suppression of the normal output waveform and its corresponding spectra. This technique of placing a low coercive force magnetic material under the dominance of a high coercive force magnetic material producing a constant biasing field is commonly used in various magnetic devices, such as magnetic digital memories. In such cases pieces of hard or high coercive force magnetic material are placed adjacent to the softer or low coercive force magnetic material. In this way, if the hard magnetic material is left in a demagnetized state, it has little or no effect on the soft magnetic material with the result that the soft material is free to respond to its normal manner to whatever outside imposed magnetic fields it may be subjected to. If, however, the hard magnetic material is left in a magnetized state, it subjects the soft magnetic material to a constant bias which essentially constrains the soft material from significantly responding to any outside imposed magnetic fields it may be subjected to.

Thus, to make our tags deactivatable we need simply place one or more pieces of hard magnetic material adjacent to the Permalloy strips so that the external magnetic field intensity of the hard magnetic material is sufficient to bias the tag material into regions of suppressed response. With one single strip the procedure is simple, however, for a tag containing many coplanar strips or arms the procedure can become complex. The reason for this is that the thin strips treat the field from the hard material just as they do the applied high and low frequency fields, that is, the field from the hard material must be roughly colinear with the long direction of the tag if it is to be effective in biasing out the tag material. The reason multi-strip coplanar tags can become troublesome is that for simplicity, one would normally prefer to apply one large strong unidirectional magnetic field to the composite tag and have it magnetize all the hard material at one time. Since the individual strips are oriented in various directions, this requires that the individual hard magnetic materials be magnetized roughly in each of these directions which requires that the large strong field be roughly in each of these directions. Sequencing the direction of the strong field offers a partial solution at times but one must be very careful not to alter the state of some previously set pieces of hard material when subsequently applying the strong field to set pieces of hard material along some other strip direction. The preferred embodiment utilizes a composite tag of two Permalloy strips oriented at right angles to each other in an "X" configuration. There are a few hard magnetic pieces adjacent and colinear to each of the Permalloy strips. In this way deactivation can be accomplished by either sequencing two large orthogonal fields or by applying one large field in the plane of the composite "X" tag which, in addition, makes an angle of about 45° with the long directions of the two strips of Permalloy. When desired, activation is accomplished by applying the well-known decaying sinusoidal demagnetizing field along this same mid-strip direction or removed by 90°.

It will now be appreciated that we have provided an improved theft detection system which greatly reduces the possibility of false alarms. It will also be appreciated that our improved theft detection system generates a magnetic field within an interrogation zone by using two different frequencies of different amplitudes and then senses and processes two lower sidebands generated by the interaction of the two different frequencies with a nonlinear magnetic tag. The system is capable of masking out any permanent background magnetic noise sources and to allow for the passage of large metallic objects through the interrogation zone without generating false alarms. The system also has greatly improved sensitivity to the tag employed so that improved detectability is obtained. The system is operable with tags which are either perpetually sensitized so as to always produce an alarm or with tags which may be desensitized by authorized personnel, such as in a library where a book has been properly signed out by a borrower.

Consequently, while in accordance with the Patent Statutes, we have described what at present are considered to be the preferred forms of our invention it will be obvious to those skilled in the art that numerous changes and modifications may be made herein without departing from the spirit and scope of the invention, and it is therefore aimed in the following claims to cover all such modifications.

What we claim as new and desire to secure by Letters Patent of the United States is:

1. A system for detecting presence of a tag within an interrogation zone, the tag having a high permeability material, comprising: means to generate a first frequency signal; means to generate a second frequency signal lower in frequency than the first frequency signal; means for combining the first and second frequency signals and for applying the combined signals to the interrogation zone so that the combined signals cause sidebands to be emitted by the tag when the tag is present within the interrogation zone; means to sense the sidebands emitted by the tag; filter means to receive the sidebands and to filter out the first and second frequency signals; mixer means to mix the first frequency signal and the sidebands to obtain base frequencies equal to the first frequency minus the frequency of the sidebands; means to determine a difference in amplitude between at least two of the base frequencies; and means to compare the difference in amplitude with a pre-established reference level so that an alarm can be generated when the difference in amplitude exceeds the pre-established level thereby indicating presence of the tag within the interrogation zone.

2. The system of claim 1 further including means to suppress one of the base frequencies when the means to sense yields an output that exceeds a pre-expected amplitude thereby reducing false alarms which could be caused by items other than the tag being present within the interrogation zone.

3. The system of claim 1 further including means responsive to an impulse generated sideband signal caused by an object other than the tag for causing one of the base frequencies to dominate the remaining base frequencies for reducing false alarms.

4. The system of claim 1 further including means to provide a signal equal to a sum of the base frequencies, and means for subtracting said signal sum from respective ones of any base frequency signals which exist when the interrogation zone is free of tags and other metallic objects thereby avoiding any false alarms which could be caused by large stationary metallic objects near the interrogation zone.

5. A method of detecting presence of a low coercive force magnetic material within an interrogation zone, comrpising: generating a first frequency signal; generating a second frequency signal wherein the second frequency signal is lower in frequency and higher in amplitude than the first frequency signal; applying the first and second frequency signals to the interrogation zone; causing a magnetic state of the magnetic material to alternate between regions of high and low differential permeability by the second frequency signal when the magnetic material is within the interrogation zone; using the first frequency signal to interrogate the magnetic material to determine difference of the differential permeabilities at the high and low regions; sensing sidebands created by use of the second frequency signal to alternate the magnetic state and the first frequency signal to interrogate the magnetic material; mixing the first frequency signal and the sidebands to obtain at least two base frequencies; and determining the difference in amplitude between the at least two base frequencies thereby verifying presence of the magnetic material within the interrogation zone.

6. The method of claim 5 further including comparing the difference in amplitude to a predetermined reference and generating an alarm when the difference in amplitude exceeds the predetermined reference.

7. A system to detect passage of an item through an interrogation zone, comprising: first means for generating a low frequency signal; second means for generating a high frequency signal; means for combining the low frequency and high frequency signals; means for producing within an interrogation zone a magnetic field of the combined signals; means for sensing perturbations caused in the interrogation zone by presence of the item within the interrogation zone; means for mixing the perturbations sensed and the high frequency signal to produce at least one base frequency equal to the difference in frequency between the high frequency signal and at least one sideband of the combined high and low frequency signals which is equal to a preselected multiple of the low frequency signal; means for comparing the at least one base frequency against a predetermined threshold level; an alarm means for creating an alarm when the amplitude of the base frequency exceeds the predetermined threshold level; and means for inhibiting the at least one base frequency from entering the means to compare whenever the perturbations contain amplitudes of the high frequency signal which are higher than expected to be caused by passage of the item through the interrogation zone thereby greatly reducing false alarms caused by objects other than the item within the interrogation zone.

8. The system of claim 7 further including means to null the perturbations sensed with the high frequency signal to reduce any high frequency signal contained within the perturbations.

9. The system of claim 7 wherein the means for mixing produces two base frequencies and wherein the system further includes means to determine difference of amplitude between the two base frequencies so that the difference of amplitude is compared against the predetermined threshold level.

10. A theft detection system for detecting the presence of an object within an interrogation zone when the object has attached thereto a tag of a high permeability magnetic material, comprising: a high frequency oscillator to provide a high frequency signal; a low frequency oscillator to provide a low frequency signal; a network for matching and summing the high and low frequency signals; a transmitting coil connected to the network for matching and summing for transmitting the summed high and low frequency signals into the interrogation zone; a receiving coil for receiving any sidebands created by the presence of the tag within the interrogation zone; a high pass filter to pass frequencies including the sidebands received by the receiving coil; a notch filter connected to the high pass filter, the notch filter filtering the high frequency signal remaining with the sidebands; an amplifier to amplify the sidebands from an output of the notch filter; a mixer connected to the amplifier and to the high frequency oscillator, the mixer combining the high frequency signal with the sidebands to produce base frequencies equal to the difference in frequency between the high frequency signal and the sidebands; a first filter and a second filter connected to an output of the mixer, the first filter being a band pass filter to pass a first of the base frequencies, the second filter being a band pass filter to pass a second of the base frequencies, an output of the first filter being connected as a feedback to the amplifier to control gain of the amplifier; a difference amplifier having as an input the output of the first filter and an output of the second filter, the difference amplifier providing an output related to difference of amplitude of the first and second base frequencies; a comparator connected to the output of the difference amplifier for comparing the difference amplifier output against a predetermined threshold level and for providing an output when the difference amplifier output exceeds the predetermined threshold level; and an alarm connected to the comparator for producing an alarm when the output from the comparator is present.

11. The theft detection system of claim 10 further including a null circuit between the high pass filter and the notch filter, the null circuit subtracting any fixed background high frequency signal which passes through the high pass filter.

12. The theft detection system of claim 10 further including means between the mixer and the bandpass filter to subtract from the output of the mixer a signal equal to a sum of the base frequencies when no tag is present in the interrogation zone, the amplitude and phase of the signal equal to the sum of the base frequencies being adjusted so that the means to subtract has no output when a tag is absent from the interrogation zone, thereby reducing possibility of having a false alarm when the tag is absent from the interrogation zone.

13. A method of detecting the presence of a high permeability magnetic tag within an interrogation zone, comprising: generating signals of two distinct frequencies; applying the signals to the interrogation zone; sensing sidebands within the interrogation zone, the sidebands being generated by interaction between the two distinct frequencies in the tag; filtering the sidebands to remove frequencies other than sideband frequencies; mixing the sideband frequencies with one of the two distinct frequencies to obtain at least one base frequency equal to a difference between the sideband frequencies and the one of the two different frequencies; filtering the at least one base frequency; inhibiting the at least one base frequency when the level of said one of the two distinct frequencies contained with the sidebands is of a greater amplitude than expected; comparing the at least one base frequency against a predetermined amplitude; and generating an alarm when the at least one base frequency exceeds the predetermined amplitude.

14. The method of claim 13 further including subtracting from signals generated by mixing the sideband frequencies with one of the two distinct frequencies a composite signal adjusted in phase and amplitude to produce a null output difference signal when the tag is absent from the interrogation zone.

15. The method of claim 13 further including generating a larger amplitude of low frequency magnetic field when generating fields of two distinct frequencies for producing a large amount of flux variation within said tag at a predetermined one of the sideband frequencies.

16. A method for detecting the presence of a magnetic tag within an interrogation zone, the magnetic tag being of a low coercive force material, comprising: generating a signal of a first frequency and a signal of a second frequency; combining the signals of a first and a second frequency and applying the signals to the interrogation zone; sensing sideband frequencies created when the magnetic tag is within the interrogation zone; filtering the sideband frequencies to eliminate undesired frequencies; providing a signal of the first frequency of proper phase and amplitude and using said signal to null any frequencies of the first frequency which exist with the sideband frequencies; mixing the filtered sideband frequencies with a signal of the first frequency for generating two base frequencies; obtaining difference in amplitude of the two base frequencies thereby determining a ratio of amplitude of the sideband frequencies; comparing the difference in amplitude of the two base frequencies against a predetermined threshold level; and generating an alarm when the output from comparison of the difference in amplitude exceeds the predetermined threshold level.

17. The method of claim 16 further including inhibiting one of the two base frequencies when contained with the sideband frequencies are frequencies of the first frequency larger in amplitude than normally expected.

18. The method of claim 16 further including generating a magnetic field of a second frequency of greater amplitude than the magnetic field of the first frequency for producing a large amount of flux variation within said tag at a predetermined one of said sideband frequencies.

19. The method of claim 16 wherein the sensing of sideband frequencies further includes sensing sidebands which are second and third lower sidebands of the signals of the first and second frequency.

20. A system for detecting passage of a marker through an interrogation zone, comprising:

means for generating a low frequency signal and a high frequency signal;

means for combining the low and high frequency signals for generating a magnetic field representative of the combined signals within the interrogation zone;

means for sensing sidebands of the combined signals generated by perturbations within the magnetic field, the perturbations being caused by the presence of the marker within the interrogation zone;

means for processing at least one preselected sensed lower sideband signal for sensitizing the processed signal to the passage of the marker; and means for comparing the at least one processed lower sideband signal with a predetermined threshold level for producing an output signal indicative of the passage of the marker within the interrogation zone when the energy level of the at least one processed lower sideband signal exceeds the threshold level.

21. A detection system according to claim 20 further comprising:

means for inhibiting the at least one processed lower sideband signal from entering the comparing means whenever the perturbations generate high frequency energy levels greater than expected to be caused by passage of the marker through the interrogation zone thereby reducing false detections caused by objects other than the marker within the interrogation zone.

22. A detection system according to claim 21 wherein the processing means processed signal is a base frequency signal of the lower sideband signal and having a frequency representative of the difference between the high frequency signal and the lower sideband signal which base frequency is a preselected multiple of the low frequency signal, the base frequency being below the high frequency.

23. A detection system according to claim 22 wherein the base frequency signal is a component of the third lower sideband signal having a frequency three times that of the low frequency signal.

24. A detection system according to claim 20 further comprising:

alarm means connected to receive the comparing means output signal for generating an alarm upon receipt of the signal.

25. A system for detecting passage of a marker through an interrogation zone, comprising:

means for generating a low frequency signal and a high frequency signal;

means for combining the low and high frequency signals for generating a magnetic field representative of the combined signals within the interrogation zone;

means for sensing sidebands of the combined signals generated by perturbations within the magnetic field, the perturbations being caused by the passage of the marker through the interrogation zone;

means for processing preselected lower ones of the sensed sidebands for producing first and second base frequency output signals, each of the first and second base frequency output signals having a frequency representative of the difference between the high frequency signal and respective ones of the preselected sensed sidebands, each of the base frequencies being a different preselected frequency multiple of the low frequency signal and below the high frequency signal; and means for comparing the energy level ratio between the processing means first and second output signals with a predetermined threshold level for producing an output signal indicative of the passage of the marker through the interrogation zone when the energy level ratio of the first and second base frequency output signals exceeds the threshold level.

26. A detection system according to claim 25 further comprising:

means for inhibiting a preselected one of the processing means base frequency output signals from entering the comparing means whenever the perturbations generate high frequency signal amplitudes higher than expected to be caused by passage of the marker through the interrogation zone thereby reducing false detections caused by objects other than the marker within the interrogation zone.

27. A detection system according to claim 26 wherein the preselected sensed lower sidebands are the second and third lower sidebands and the corresponding first and second base frequency output signals have respective frequencies two and three times that of the low frequency signal.

28. A detection system according to claim 27 wherein the preselected sensed second and third lower sidebands have energy contents indicative of the passage through the interrogation zone of an object other than the marker and the marker, respectively.

29. A detection system according to claim 25 further comprising:

alarm means connected to receive the comparing means output signal for generating an alarm upon receipt of the signal.

30. A system for detecting passage of a marker through an interrogation zone, comprising:

means for generating a low-frequency signal and a high-frequency signal;

means for combining the low and high frequency signals for generating a stationary magnetic field representative of the combined signals within the interrogation zone;

means for sensing sidebands of the low and high frequency signals generated by perturbations within the magnetic field, the perturbations being caused by the presence of the marker within the interrogation zone; and means for processing at least one preselected sensed sideband signal for producing an output signal indicative of the passage of the marker through the interrogation zone.

31. A detection system according to claim 30 wherein said processing means further includes means for processing first and second preselected sensed sideband signals, the first preselected sideband signal being indicative of the presence of the marker within the interrogation zone and the second preselected sideband signal being indicative of the presence of an object other than the marker within the interrogation zone and means for comparing the energy levels between the first and second preselected sideband signals for producing an output signal indicative of the passage of the marker through the interrogation zone when the energy level of the first sideband signal exceeds the energy level of the second sideband signal.

* * * * *